US009181502B2

(12) United States Patent
Liu et al.

(10) Patent No.: US 9,181,502 B2
(45) Date of Patent: Nov. 10, 2015

(54) GASIFICATION OF HIGH ASH, HIGH ASH FUSION TEMPERATURE BITUMINOUS COALS

(71) Applicant: The Southern Company, Birmingham, AL (US)

(72) Inventors: Guohai Liu, Birmingham, AL (US); Pannalal Vimalchand, Birmingham, AL (US); WanWang Peng, Birmingham, AL (US)

(73) Assignee: SOUTHERN COMPANY, Birmingham, AL (US)

( * ) Notice: Subject to any disclaimer, the term of this patent is extended or adjusted under 35 U.S.C. 154(b) by 211 days.

(21) Appl. No.: 13/936,457

(22) Filed: Jul. 8, 2013

(65) Prior Publication Data

US 2014/0008580 A1 Jan. 9, 2014

Related U.S. Application Data

(60) Provisional application No. 61/669,451, filed on Jul. 9, 2012.

(51) Int. Cl.

| | |
|---|---|
| ***C10J 3/56*** | (2006.01) |
| ***C10J 3/84*** | (2006.01) |
| ***C10J 3/72*** | (2006.01) |

(Continued)

(52) U.S. Cl.

CPC .. *C10J 3/56* (2013.01); *C10J 3/721* (2013.01); *C10J 3/84* (2013.01); *C10K 1/024* (2013.01); *C10K 1/026* (2013.01); *C10K 3/005* (2013.01); *C10J 2300/093* (2013.01); *C10J 2300/094* (2013.01); *C10J 2300/0976* (2013.01); *C10J 2300/1838* (2013.01);

(Continued)

(58) Field of Classification Search

CPC combination set(s) only.

See application file for complete search history.

(56) References Cited

U.S. PATENT DOCUMENTS 2,677,603 A * 5/1954 Van Loon ..... 48/76
3,820,964 A * 6/1974 Janka ..... 48/113

(Continued)

OTHER PUBLICATIONS

International Preliminary Report on Patentability in related PCT Application No. PCT/US2013/049566, mailed Jan. 13, 2015.

(Continued)

*Primary Examiner* — Kaity Handal

(74) *Attorney, Agent, or Firm* — Troutman Sanders LLP; Ryan A. Schneider; Dustin B. Weeks

(57) ABSTRACT

This invention relates to gasification of high ash bituminous coals that have high ash fusion temperatures. The ash content can be in 15 to 45 weight percent range and ash fusion temperatures can be in 1150° C. to 1500° C. range as well as in excess of 1500° C. In a preferred embodiment, such coals are dealt with a two stage gasification process—a relatively low temperature primary gasification step in a circulating fluidized bed transport gasifier followed by a high temperature partial oxidation step of residual char carbon and small quantities of tar. The system to process such coals further includes an internally circulating fluidized bed to effectively cool the high temperature syngas with the aid of an inert media and without the syngas contacting the heat transfer surfaces. A cyclone downstream of the syngas cooler, operating at relatively low temperatures, effectively reduces loading to a dust filtration unit. Nearly dust- and tar-free syngas for chemicals production or power generation and with over 90%, and preferably over about 98%, overall carbon conversion can be achieved with the preferred process, apparatus and methods outlined in this invention.

20 Claims, 3 Drawing Sheets

(51) Int. Cl.
*C10K 1/02* (2006.01)
*C10K 3/00* (2006.01)

(52) U.S. Cl.
CPC . *C10J 2300/1846* (2013.01); *C10J 2300/1884* (2013.01); *C10J 2300/1892* (2013.01)

(56) References Cited

U.S. PATENT DOCUMENTS

| | | | | |
|---|---|---|---|---|
| 4,347,064 | A | 8/1982 | Reh et al. | |
| 5,425,317 | A | 6/1995 | Schaub et al. | |
| 6,455,011 | B1 | 9/2002 | Fujimura et al. | |
| 7,771,585 | B2 | 8/2010 | Vimalchand et al. | |
| 8,066,789 | B2 | 11/2011 | Liu et al. | |
| 8,349,504 | B1 * | 1/2013 | Radovich | 429/426 |
| 2004/0100902 | A1 | 5/2004 | Vimalchand et al. | |
| 2005/0109603 | A1 * | 5/2005 | Graham | 201/25 |
| 2010/0263342 | A1 | 10/2010 | Liu et al. | |
| 2013/0026417 | A1 * | 1/2013 | Paquet et al. | 252/373 |

OTHER PUBLICATIONS

International Search Report in related PCT Application No. PCT/US2013/049566, mailed Dec. 16, 2013.
Examination Report in Related Qatar Application No. QA/201412/00453, mailed Jul. 17, 2015.

* cited by examiner

GASIFICATION OF HIGH ASH, HIGH ASH FUSION TEMPERATURE BITUMINOUS COALS

CROSS-REFERENCE TO RELATED APPLICATIONS

This application claims the benefit of U.S. Provisional Application No. 61/669,451 filed 9 Jul. 2012, the entire contents and substance of which are hereby incorporated by reference.

STATEMENT REGARDING FEDERALLY SPONSORED RESEARCH OR DEVELOPMENT

This invention was made with Government support under Agreement/Contract Number DE-NT0000749, awarded by the United States Department of Energy. The Government has certain rights in the invention.

BACKGROUND OF THE INVENTION

1. Field of Invention

This invention relates to gasification of high ash bituminous coals that have high ash fusion temperatures. Existing fluidized bed gasifiers are unsuitable to process such coals economically as these coals are less reactive which leads to lower carbon conversion and generating undesirable components such as tar. If such coals are gasified in slagging entrained flow gasifiers that operate at higher temperatures to improve carbon conversion, the large energy penalty associated with slags, containing a large amount of additives that are necessary to lower ash fusion temperature, make the process economically unviable. In this invention, such coals are dealt with a two stage gasification process—a primary gasification step followed by a high temperature partial oxidation step of residual char carbon and small quantities of tar. The process is further beneficial with the inclusion of an internally circulating fluidized bed to effectively cool the high temperature syngas.

2. Background and Related Art

Those of skill in the art of coal gasification know that some bituminous coals are unsuitable for use in existing commercial gasifiers economically or practically. The initial ash deformation temperatures of these bituminous coals as measured by ASTM D-1857 are well above 1500° C. It becomes very difficult to melt the ash for gasifiers that rely on slagging the ash in the gasification process, such as conventional GE, Shell and E-Gas gasifiers. For these and other such gasifiers, to gasify the high ash fusion temperature coals, the gasifier operating temperature will be too high even with added fluxing agents and such operation shortens the life span of linings in the gasifier. Further, the high ash bituminous coals can contain up to approximately 45 weight percent (wt %) ash in the coal. Even with addition of, for example, approximately 20 wt % fluxing agents to lower the coal ash fusion temperature, the energy penalty to melt the large amount of ash is simply too high and leads to an inefficient and unreliable gasification process. Further, it would be difficult to operate these gasifiers due to large amount of slag flow of combined ash and fluxing agent. The high ash and high ash fusion temperature bituminous coals have been precluded from many existing gasification technologies.

It is also difficult to gasify these coals in conventional fluidized bed gasifiers as the bituminous coals have quite low reactivities with gasification agents. The fundamental reason for the low reactivity in a fluidized bed is that the operating temperature is limited due to the tendency for clinker formation. Once clinkers form, the gasifier looses fluidization and functional capabilities. Although the ash fusion temperature is high, the gasifier will form clinker a few hundred degrees of Celsius below the ash fusion temperature as the surfaces of burning coal particles have a much higher temperature than the measured bulk temperature in the fluidized bed. Further, the temperature in a fluidized bed gasifier is rarely uniform due to hot spots in some parts of the bed that tend to melt the surface of coal ash particles, leading to agglomerates and eventual clinker formation. Therefore, it is very rare for a fluidized bed gasifier to operate above approximately 1100° C. without bed fouling in spite of the coal ash fusion temperatures well above approximately 1500° C. Because of the operating temperature limitations, the carbon conversion in the fluidized bed process is generally below approximately 90%. The remaining carbon has to be combusted in a combustor (with all of the associated equipment in the combustion train) for economic viability, leading to increased capital and operating and maintenance costs for the gasification process. Thus, existing fluidized bed gasifiers cannot handle bituminous coals economically. Further, gasification of bituminous coals in fluidized beds generates small quantities of tar in the syngas, which is hard to remove and it becomes expensive to treat the syngas. Without treatment for tar in the syngas, the downstream equipment such as syngas cooler and dust filters tend to foul, leading to operational reliability concerns.

It is more difficult to gasify these types of bituminous coals in a moving bed gasifier. Most bituminous coals have some caking tendency and the moving bed gasifier has difficulty handling caking coals. The carbon conversion is even lower than in fluidized bed gasifiers due to limitations related to operating temperature. In addition, the moving bed gasifier generates large amount of tar and phenol water that requires expensive processes to treat to meet today's environmental regulations.

Two-stage gasification is known. The fixed bed or moving bed two-stage gasifier was developed to produce two different syngas streams in U.S. Pat. No. 5,139,535. One stream contains tar and carbonization gas and the other is product syngas from coal gasification. Due to low capacity, lower yield of product syngas and high wastewater production, the two stage moving bed gasifiers are obsolete.

There are various two-stage fluidized bed gasification systems. One type uses a two-vessel arrangement with a combustor and a gasifier. The flue gas from the combustor together with hot solids recycling between the gasifier and the combustor is fed into the gasifier to provide heat for the endothermic gasification reactions. U.S. Pat. No. 4,386,940 discloses one of these types. However, those skilled in the art of gasification understand that the problem is not how to provide the heat to the gasifier, but how to convert enough carbon and coal into desirable syngas constituents carbon monoxide and hydrogen. In the normal operating temperature range of up to approximately 1100° C. in such a two stage system, the coal conversion to carbon monoxide and hydrogen is too low with undesirable components such as tar still present in the syngas. Therefore, combustion and gasification in two separate vessels, and then routing the flue gas to the gasifier, is essentially no different than using a single gasifier with combustion and gasification zones.

U.S. Patent Publication No. 2013-0056685 discloses using a two-stage gasifier to accomplish high carbon conversion. The first-stage gasifier or pyrolyzer operates at approximately 500-700° C. and the second-stage operates at 1400-1500° C. The ash from the second-stage gasifier is melted and discharged as molten slag. This concept is similar to the one of U.S. Pat. No. 6,455,011 that discloses a method to gasify waste in a two-stage gasifier system. The first-stage gasifier is a fluidized bed gasifier and the second-stage is a swirl or cyclonic gasifier and ash is melted and discharged as slag. Yet, these methods incorporate the same difficulties and poor economics in handling high ash bituminous coals with high ash fusion temperatures as the entrained flow gasifiers.

Another two-stage entrained flow slagging gasifier is disclosed in U.S. Pat. No. 8,444,724. Since this type of gasifier requires melting and slagging the ash and fluxing agents, it cannot viably be used for those coals with high ash content and high ash fusion temperatures.

It is thus readily apparent that present coal gasification technologies cannot economically process coals with high ash content and high ash fusion temperatures. In addition to ably gasifying such coals, the layout of the process and design of downstream equipment also plays a significant role in skillfully generating high yields of nearly dust-free syngas for chemical synthesis or power generation end use.

It is an intention of the present invention to provide a process, appropriate apparatus and method for operating the series of apparatus that can gasify the high ash, high ash fusion temperature bituminous coals with carbon conversions above approximately 90%, and preferably above approximately 98%, while providing nearly tar-free syngas for further processing downstream to end-use chemicals or power generation.

BRIEF SUMMARY OF THE INVENTION

Briefly described, in a preferred form, the present invention comprises a system of apparatus and methods to gasify bituminous coals with ash content above approximately 15 wt % and ash having initial deformation temperatures above approximately 1500° C. The system comprises a circulating fluidized bed transport gasifier operating at a relatively low temperature of approximately 900° C. to approximately 1100° C. with an oxidant containing from approximately 30% to nearly approximately 100% oxygen depending upon syngas end-use. The gas superficial velocity in a riser of the first-stage transport gasifier is in the range of approximately 12 to approximately 50 feet/second (ft/s) and the operating pressure at the exit of the first-stage is in the range of approximately 30 psia to approximately 1000 psia, again depending on the end-use of the gasification product stream. This serves as a primary gasifier converting up to approximately 90 wt % of carbon to various syngas components including small quantities of heavy organic components, including among others, char carbon and tar. The carbon fraction in the tar from fluidized beds processing less reactive bituminous coals can be in range of approximately 3 wt % to approximately 10 wt % of total carbon in the syngas.

The residual char carbon and tar from the gasifier is then thermally cracked and converted to useful syngas components in a high temperature fluidized bed partial oxidizer operating at a relatively high temperature of approximately 1100° C. to approximately 1400° C. The operating temperature of the second-stage fluidized bed partial oxidizer depends on the initial ash deformation temperature of the bituminous coal fed to the first-stage transport gasifier. The gas superficial velocity in the second-stage gasifier is in the range of approximately 3 ft/s to approximately 6 ft/s.

The present two-step process can achieve over approximately 98% overall carbon conversion to useful syngas components while beneficially limiting if not avoiding clinker and agglomerate formations providing for longer life of the linings and other internals of both the transport gasifier (due to relatively low temperature) and partial oxidizer (due to low volumes of char carbon and tar).

The high temperature syngas from the second-stage partial oxidizer is cooled in an internally circulating fluidized bed of inert media that transfers heat energy from the syngas to heat transfer surfaces. As the syngas preferably does not contact the heat transfer surfaces directly, issues related to corrosion, erosion and fouling are limited, if not eliminated. The syngas outlet temperature from the syngas cooler is in the range of approximately 300° C. to approximately 500° C.

A cyclone downstream of the syngas cooler captures unconverted char carbon for recycling back, as necessary, to the second-stage partial oxidizer. The cyclone also decreases the loading on a downstream dust filtration unit. The fines collected by the filtration unit are cooled and depressurized for disposal, and the clean syngas can be used for desired chemical synthesis or power generation.

The present invention modifies the conventional transport gasifier and internally circulating fluidized bed syngas cooler in order to process high ash, high ash fusion temperature bituminous coals. Specific conditions and methods to operate the individual apparatus and the system as a whole are also described below.

In an exemplary embodiment, the present invention comprises a gasification system for high ash, high fusion temperature bituminous coal comprising a gasifier combining bituminous coal and an oxidant to produce syngas, the syngas containing at least one unwanted species, a partial oxidizer that receives the syngas and converts at least a portion of the unwanted species into syngas, a syngas cooler to cool the syngas from the partial oxidizer, an unwanted species removal system that removes at least a portion of the unwanted species from the syngas from the syngas cooler, and a removal system-to-partial oxidizer return feed to return at least a portion of the unwanted species from the removal system to the partial oxidizer. The system can further comprise a filtration unit through which the cooled syngas passes.

The gasifier can operate at a temperature of approximately 900° C. to approximately 1100° C. to produce the syngas containing at least one unwanted species. The partial oxidizer can operate at a temperature of approximately 1100° C. to approximately 1400° C.

The unwanted species can comprise char carbon. Another unwanted species can comprise tar.

The partial oxidizer can receive the syngas containing char carbon and tar from the gasifier, and convert at least a portion of the char carbon and tar into additional syngas at a temperature in the range of approximately 1100° C. to approximately 1400° C.

The unwanted species removal system can comprise a cyclone downstream that collects at least a portion of unreacted char carbon.

The removal system-to-partial oxidizer return feed can feed at least a portion of the char carbon collected by the unwanted species removal system downstream of the syngas cooler to the partial oxidizer to achieve better carbon utilization.

The syngas cooler can comprise a multistage syngas cooler cooling the syngas from the partial oxidizer operating temperature to an inlet filtration unit temperature.

In another exemplary embodiment, the present invention comprises a gasification system that can gasify high ash, high fusion temperature bituminous coal comprising a gasifier that takes bituminous coal as feed and along with oxygen or air as an oxidant and operating at a relatively low temperature in the range of approximately 900° C. to approximately 1100° C. to produce the syngas containing an unwanted species, for example, char carbon and tar, a partial oxidizer that receives the syngas containing char carbon and small quantities of tar from the gasifier and converts the char carbon and tar into additional syngas at a relatively high temperature in the range of approximately 1100° C. to approximately 1400° C., a multistage syngas cooler that can cool the syngas from the partial oxidizer operating temperature to a desired dust filtration unit operating temperature, a cyclone downstream of the syngas cooler and upstream of the particle filters to collect the unreacted char carbon from the process, and a char carbon return loop that feeds the char carbon collected by the cyclone downstream of the syngas cooler to the partial oxidizer to achieve better carbon utilization, wherein fines are cooled and depressurized for disposal, and wherein the clean syngas can be used for desired chemical synthesis or power generation.

The system can be operated in an air blown mode primarily for generating power or in an oxygen blown mode for producing chemicals or generating power.

The system can be operated in the range of approximately 30 psia to approximately 1000 psia.

The low temperature gasification and high temperature partial oxidation processes can achieve over approximately 98% carbon conversion and produce nearly dust-free and tar-free syngas.

The gasifier can be configured as a circulating fluidized bed transport gasifier with bituminous coal fed tangentially into a dense bed and in an oxygen rich lower region of the gasifier to minimize caking tendencies of bituminous coal.

The partial oxidizer can be configured as a fluidized bed with oxygen or enriched oxygen as an oxidant to further gasify fine refractory char carbon and tar in the syngas.

The syngas cooler can be configured as an internally circulating fluidized bed cooler to cool the syngas from approximately 1400° C. to approximately 300° C. to approximately 500° C. while generating steam and superheated steam. The cooler preferably minimizes material, fouling, corrosion, erosion and maintenance issues related to heat transfer surfaces as the configuration avoids direct contact of syngas with heat transfer surfaces.

The cyclone downstream of syngas cooler can be configured to operate at 300° C. to approximately 500° C., and effectively capture unconverted fine char carbon and minimize loading to a downstream dust filtration unit.

In another exemplary embodiment, the present invention comprises a gasification system for high ash, high ash fusion temperature bituminous coal comprising a gasifier combining a bituminous coal stream and a gasifier oxidant stream to produce a gasifier syngas stream containing an unwanted species at a first concentration, wherein the gasifier operates within an operating gasifier temperature range, an operating gasifier gas superficial velocity range, and an operating gasifier pressure range at an exit of the gasifier, a partial oxidizer that combines the gasifier syngas stream and a partial oxidizer oxidant stream to produce a partial oxidizer syngas stream containing the unwanted species at a second concentration being lower than the first concentration, wherein the partial oxidizer operates within an operating partial oxidizer temperature range, an operating partial oxidizer gas superficial velocity range, and an operating partial oxidizer pressure range at an exit of the partial oxidizer, an unwanted species removal system that removes at least a portion of an unwanted species from the partial oxidizer syngas stream, and a syngas cooler to cool the partial oxidizer syngas stream.

The gasification system can further comprise a removal system-to-partial oxidizer return feed to return at least a portion of an unwanted species via an unwanted species stream from the removal system to the partial oxidizer, wherein the partial oxidizer combines steam and the unwanted species stream with the gasifier syngas stream and a partial oxidizer oxidant stream to produce the partial oxidizer syngas stream.

The gasification system can further comprise a filtration system through which the cooled partial oxidizer syngas stream passes.

The system can achieve over approximately 90% carbon conversion into syngas gasifying bituminous coals with ash content above approximately 15 wt % and the ash having initial deformation temperatures above approximately 1500° C.

The system can achieve over approximately 98% carbon conversion into syngas gasifying bituminous coals with ash content above approximately 15 wt % and the ash having initial deformation temperatures above approximately 1500° C.

The gasifier can be a circulating fluidized bed transport gasifier, and the partial oxidizer can be a fluidized bed partial oxidizer.

Steam can be combined with the bituminous coal stream and a gasifier oxidant stream to produce the gasifier syngas stream.

The operating gasifier temperature range can be approximately 900° C. to approximately 1100° C., the operating gasifier gas superficial velocity range can be approximately 12 ft/s to approximately 50 ft/s, and the operating gasifier pressure range at an exit of the gasifier can be approximately 30 psia to approximately 1000 psia.

The operating partial oxidizer temperature range can be approximately 1100° C. to approximately 1400° C., the operating partial oxidizer gas superficial velocity range can be approximately 3 ft/s to approximately 6 ft/s, and the operating partial oxidizer pressure range at an exit of the partial oxidizer can be approximately 5 psia to approximately 35 psia lower than the gasifier pressure range at the exit of the gasifier.

The operating gasifier temperature range can at least be 350° C. below the ash initial deformation temperature.

The unwanted species can comprise one or more of char carbon, tar and fines.

In another exemplary embodiment, the present invention comprises a method of gasifying high ash, high ash fusion temperature bituminous coal to achieve above approximately 98% carbon conversion, the method comprising feeding bituminous coal particles of an average size of less than approximately 1000 microns into an oxygen rich, lower riser dense bed environment of a circulating fluidized bed transport gasifier, operating the gasifier at a relatively low temperature of approximately 900° C. to approximately 1100° C., feeding fine refractory char carbon and tar in the syngas from the gasifier to a partial oxidizer, operating the partial oxidizer at a relatively high temperature of approximately 1100° C. to approximately 1400° C. to generate additional syngas, cooling the syngas in an internally circulating fluidized bed cooler using an inert circulating media to transfer heat from the syngas to heat transfer surfaces and without the heat transfer surfaces directly contacting the syngas, separating fine char carbon and ash from the syngas in a cyclone operating at a low temperature of approximately 300° C. to approximately 500° C. to reduce loading to a downstream dust filtration unit, recycling fines, as necessary, to the partial oxidizer to achieve a desired carbon conversion, filtering dust in a dust filtration unit to produce a clean syngas stream for further downstream processing, and depressurizing the dust from the cyclone and filtration unit for storage and disposal.

The circulating fluidized bed transport gasifier can operate at a superficial gas velocity in the range of approximately 12 ft/s to approximately 50 ft/s.

The gas velocity along with solids circulation rate and feed coal particle size can be adjusted to minimize discharge of char carbon and ash from the gasifier under normal operating conditions, and the unreacted char carbon and ash exiting the gasifier along with the syngas.

The partial oxidizer operating temperature can be controlled by adjusting the oxygen flow and steam-to-oxygen ratio based on the char carbon and tar contents in the syngas entering the oxidizer.

These and other objects, features and advantages of the present invention will become more apparent upon reading the following specification in conjunction with the accompanying drawing figure.

DETAILED DESCRIPTION OF THE INVENTION

Figure 1:
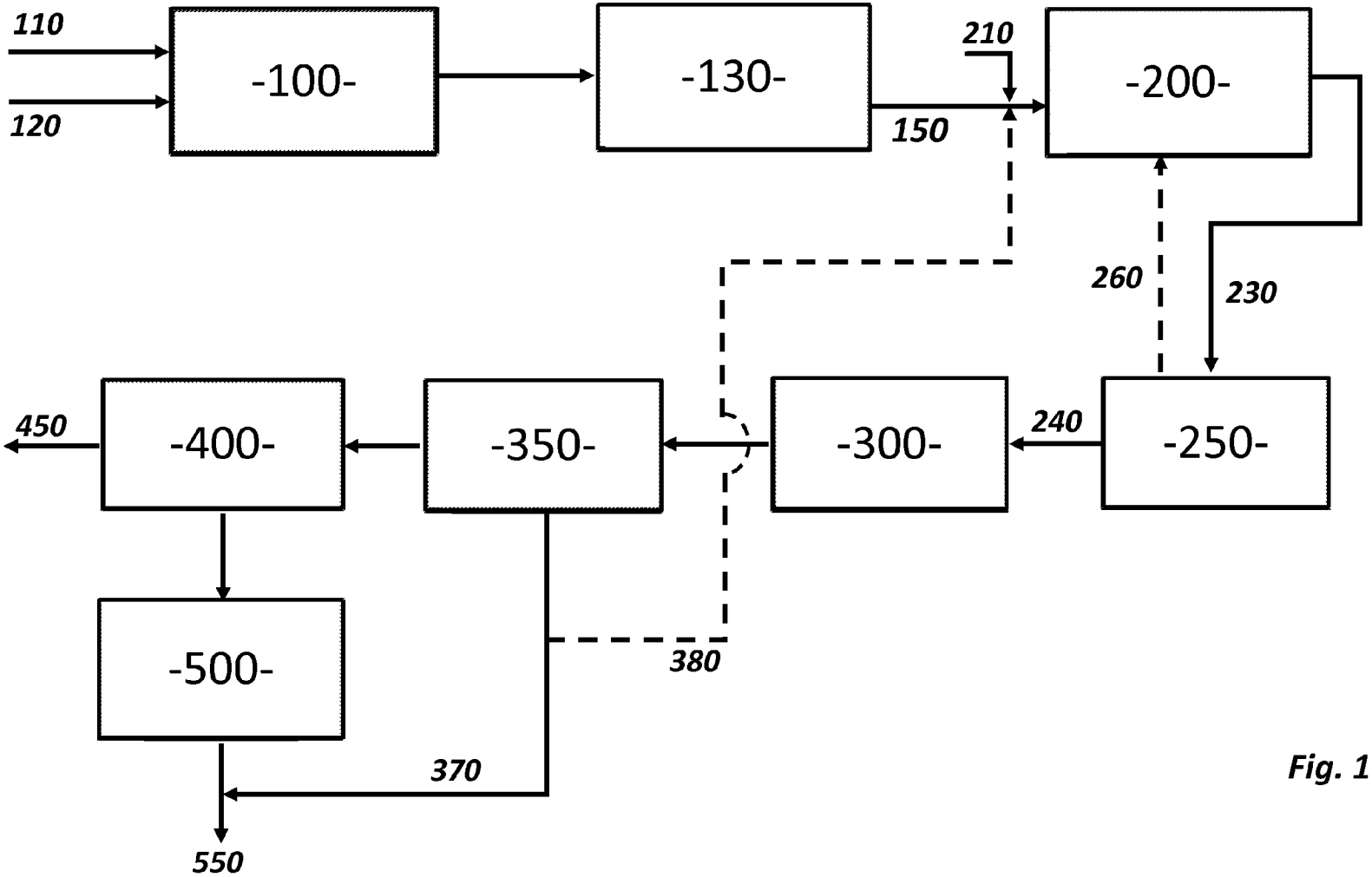
FIG. 1 is a schematic view of a system to process high ash, high ash fusion temperature bituminous coals according to a preferred embodiment of the present invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" or "nearly free" of something, or "substantially pure", and like char carbon characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

The term "stream" is used herein to include numerous ways for a material to move from one location to another. For example, a "coal stream" or "oxidant stream" does not necessarily imply a continuous flow, or that the stream is liquid or gas-based. A "coal stream" delivered to a vessel indicates that coal from outside the vessel is transported into the vessel, where the coal could be liquid or gas entrained, and where the coal can be particles of coal. Thus, where a vessel combines two streams, it again contemplates that two materials mix within the vessel, not necessary that continuous streams of the materials are mixed within the vessel. The delivery via the stream can be discontinuous, discrete, or continuous.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

The invention is intended to gasify bituminous coals with ash content higher than approximately 15 wt % and with an ash fusion temperature substantially higher than approximately 1500° C. The invention is also intended to gasify other bituminous coals with high ash content in the range of approximately 25 wt % to approximately 45 wt %, but with lower ash fusion temperatures in the range of approximately 1150° C. to approximately 1500° C. that are not economically feasible to gasify in existing gasifiers such as slagging entrained flow gasifiers.

Figure 2:
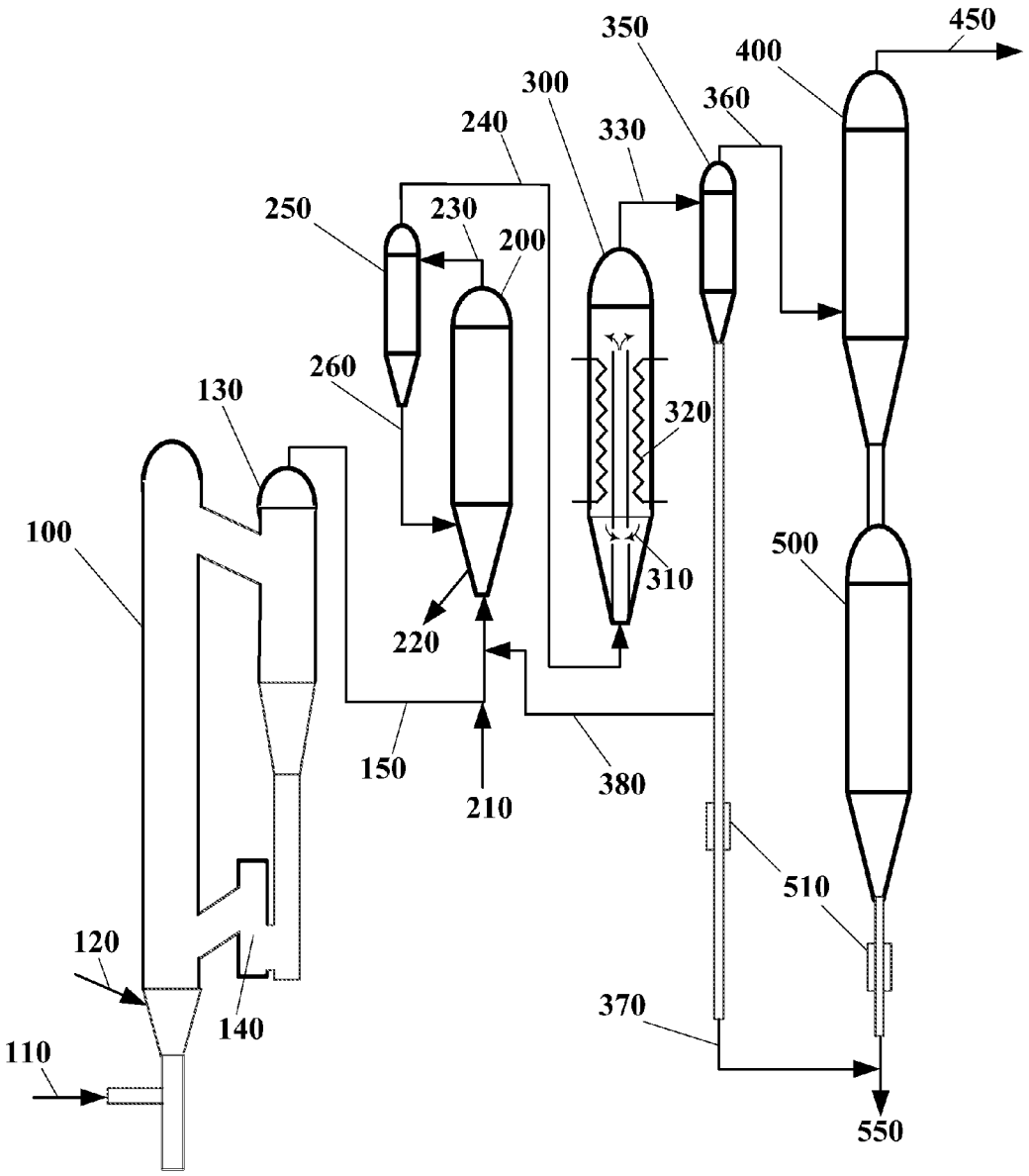
FIG. 2 is another schematic view of a system to process high ash, high ash fusion temperature bituminous coals according to a preferred embodiment of the present invention.

Referring to FIGS. 1-2, a preferable gasification system for high ash, high ash fusion temperature bituminous coal comprises a gasifier 100 combining a bituminous coal stream 120, a gasifier oxidant stream 110, and steam, to produce a syngas stream 150, the syngas stream 150 containing at least one unwanted species, for example, char carbon and/or tar. The gasifier 100 operates at an operating gasifier temperature range, operating gasifier gas superficial velocity range, and operating gasifier pressure range at the exit of the gasifier. Preferably, the operating gasifier temperature range is approximately 900° C. to approximately 1100° C. Preferably, the operating gasifier gas superficial velocity range is approximately 12 ft/s to approximately 50 ft/s. Preferably, the operating gasifier pressure range at the exit of the gasifier is approximately 30 psia to approximately 1000 psia.

The partial oxidizer 200 receives the syngas stream 150 and converts at least a portion of the unwanted species into syngas stream 230. The partial oxidizer combines the syngas stream 150 with a partial oxidizer oxidant and steam stream 210, and a collected bed particle (bed material) stream 260 from an unwanted species removal system 250. The partial oxidizer 200 also promotes steam gasification and other gasification reactions in converting a portion of unwanted species into syngas. The partial oxidizer 200 operates at an operating partial oxidizer temperature range, operating partial oxidizer gas superficial velocity range, and operating partial oxidizer pressure range at the exit of the partial oxidizer. Preferably, the operating partial oxidizer temperature range is approximately 1100° C. to approximately 1400° C. Preferably, the operating partial oxidizer gas superficial velocity range is approximately 3 ft/s to approximately 6 ft/s. Preferably, the operating partial oxidizer pressure range at the exit of the partial oxidizer is approximately 5 psia to approximately 35 psia lower than the gasifier pressure range at the exit of the gasifier.

As the second-stage partial oxidizer 200 relies on operating the fluidized bed with much reduced char carbon content to limit or avoid clinker formation, a first-stage cyclone 130 can be used in the first-stage transport gasifier 100 to limit exiting char carbon particles greater than, for example, approximately 50 microns, which are collected in a first-stage cyclone 130 and retained in the circulating bed material for further reaction in the oxidant rich zone of the gasifier 100.

The unwanted species removal system 250 receives the syngas stream 230, and removes at least a portion of the unwanted species from the syngas stream 230, which unwanted species can comprise char carbon and tar, among other species. In a preferred embodiment, system 250 comprises a second-stage cyclone 250.

The removal system-to-partial oxidizer collected bed particles stream 260 returns at least a portion of the unwanted species from the removal system 250 to the partial oxidizer 200.

Syngas stream 240 exiting the second-stage cyclone 250 contains mostly fine ash and any unreacted fine char carbon dust. The relatively hot syngas stream 240 that will be within the operating partial oxidizer temperature range then enters a syngas cooler 300 to cool the syngas from the second-stage cyclone 250/partial oxidizer 200. The syngas cooler 300 cools the syngas stream 240 to a syngas cooler temperature range. Preferably, the syngas cooler temperature range is approximately 300° C. to approximately 500° C., and the syngas cooler 300 generates steam and superheat steam while cooling the syngas.

A third cyclone 350 can be located downstream of the syngas cooler 300, and is effective in collecting unreacted char carbon from inlet syngas stream 330 as it operates at lower temperature and higher loads due to fine ash particles that pass through the syngas cooler 300.

The syngas stream 360 exiting the third cyclone 350 can enter a filtration system 400. Preferably, filtration system 400 can reduce the dust concentration at the inlet of system 400 to a filtration range at the exit of the system 400, producing a nearly dust-free syngas stream 450 for downstream end-use. Preferably, the filtration system 400 filtration range is approximately 0.1 ppmw to approximately 1 ppmw dust concentration in the syngas exit stream 450 from system 400.

Fines from the filtration system 400 can be collected in a fines receiver vessel 500 and disposed through stream 550 after further cooling and depressurization using, for example, a Continuous Fine Ash Depressurization (CFAD) system 510 disclosed in U.S. Pat. No. 8,066,789, which is hereby incorporated by reference. A portion of collected fines 380 from third cyclone 350 can be recycled back to the partial oxidizer 200 and/or cooled and depressurized through another CFAD system 510 as stream 370 and disposed through stream 550.

More particularly, the gasifier 100 operates as a circulating fluidized bed transport gasifier processing feed coal particles below a mean size of approximately 1000 microns, with a mass mean particle size in a preferred range of approximately 150 microns to approximately 300 microns depending upon the reactivity of the bituminous coal. Various sections and functionality of the transport gasifier are described in U.S. Pat. No. 7,771,585 and U.S. Patent Publication No. 2011-0146152, which are incorporated herein by reference. A gasifier oxidant stream 110, for example, preferably oxygen and/or air, is added to the gasifier to partially react with the carbon particles to provide the heat energy necessary for the gasification reactions and to maintain the gasifier temperature. In an exemplary embodiment, the use of enriched air improves economics by blending oxygen from an air separation unit that can be located in an air-blown gasification plant to provide nitrogen for inerting purposes. The operating temperature of the gasifier is relatively low and in the range of approximately 900° C. to approximately 1100° C. The operating pressure of the gasifier is preferred to be in the range of approximately 30 psia to approximately 1000 psia.

To gasify bituminous coals in the transport gasifier, the coal stream 120 is fed to a cone region of lower riser portion of the gasifier 100 so the coal particles under the inertial force of feeding jets and gravity will descend downwards initially and come in contact with gasifier oxidant stream 110 from the bottom of the gasifier. As the fed coal particles start to heat-up in an oxygen environment, the caking tendency of the coal is minimized. Further, the coal stream 120 is fed with downwardly pointing tangential nozzles and the stream interacts with solids flowing downward along the wall of the gasifier. This interaction increases the solids circulation rate toward the bottom of the gasifier and improves the dispersion of oxidant and steam fed from the bottom of the gasifier. The mixing of coal and circulating solid particles dilutes the concentration of fresh coal particles and minimizes the potential for caking coal particles to stick to one another to form agglomerates.

In another embodiment of the present invention, the coal can also be fed into a riser section of a loop seal 140, where the caking coal can be mixed with approximately 100 times the weight of circulating solids to reduce the chance of the caking coal particles to form agglomerates. A further measure to combat strong caking coal tendencies is to add a small amount of oxidant, for example oxygen, to the coal conveying gas. The oxygen fed into the riser of the loop seal 140 will be rapidly dispersed by the circulating solids so that any temperature increase near the coal feed point will be minimized.

Steam can be added in the cone and other regions of the gasifier to partially regulate the gasifier temperature and also react with the coal particles to produce syngas. The gasifier temperatures are also regulated by the solids circulation from a standpipe. The gas velocity along with solids circulation rate and feed coal particle size can be adjusted to minimize discharge of ash or other unwanted species from the gasifier under normal operating conditions. Under this operation, excess (unreacted) char carbon will entrain with the syngas exiting the gasifier and be fed into the second-stage partial oxidizer 200 for further conversion.

The char carbon generated in the gasifier 100 upon gasification of bituminous coal is highly refractory in nature and is difficult to convert to useful syngas at the relatively low first-stage transport gasifier operating conditions. The gasification in gasifier 100 also generates tar due to limited operating conditions. The second-stage partial oxidizer 200, which can be another fluidized bed reactor, receives the hot syngas carrying potentially a substantial amount of fine refractory char carbon particles and other large organic components that will become tar when the syngas is cooled to below approximately 250° C. These large organic components are collectively referred to herein sometimes as tar fraction in the syngas. A small fraction of oxidant (air, enriched air or oxygen) and steam through stream 210 can be added to the partial oxidizer to further thermally convert the unreacted char carbon and tar.

The operating temperature of the second-stage partial oxidizer is relatively high and can be in the range of approximately 1100° C. to approximately 1400° C. or up to approximately 100° F. below the coal ash initial deformation temperatures. The operating pressure of the partial oxidizer can be approximately 5 psia to approximately 35 psia lower than the first-stage gasifier 100. The partial oxidizer temperature is maintained by adjusting the oxidant flow and steam-to-oxygen ratio in stream 210 based on the char carbon and tar contents in the inlet syngas stream. The second-stage partial oxidizer can operate in a turbulent fluidization regime and the superficial gas velocity can be in the range approximately 3 ft/s to approximately 6 ft/s to minimize the height of the partial oxidizer and maximize the gas residence time.

The individual char carbon particles are at a substantially higher temperature than the bulk bed in a fluidized bed gasifier due to surface oxidation of char carbon particles. This can potentially lead to agglomerate and clinker formation even when the gasifier bulk temperature is approximately 100° C. below the ash initial deformation temperature. In addition, the char carbon concentration is relatively high in the fluidized bed when gasifying low reactivity coals. The oxidant added to the gasifier will be rapidly consumed in a relatively small volume of the gasifier, potentially leading to hot spots and clinker formation. In response to these issues, in a preferred embodiment of the present invention, the operating temperature in the first-stage transport gasifier will be more than approximately 400° C. below the ash initial deformation temperature to limit if not completely avoid clinker formation.

The operating temperature in the second-stage partial oxidizer can be higher than in the first-stage transport gasifier. A preferred operating temperature in the second-stage partial oxidizer can be approximately 30° C. to approximately 50° C. below the ash initial deformation temperature, but preferably not exceeding approximately 1400° C. This higher temperature ensures substantial conversion of fine char carbon and tar in the second-stage.

The second-stage partial oxidizer relies on operating the fluidized bed with much reduced char carbon content to limit or avoid clinker formation. The design of the first-stage cyclone 130 in the first-stage transport gasifier practically ensures that char carbon particles greater than approximately 50 microns are collected and retained in the circulating bed material for further reaction in the oxidant rich zone. The amount of char carbon generated can be approximately 10 wt % to approximately 20 wt % of coal carbon that is fed into the first-stage transport gasifier. Only a relatively small fraction of the fine char carbon generated and not collected by the first-stage gasifier cyclone is fed (via syngas stream 150) into the second-stage partial oxidizer where at least a portion of it is converted into syngas. A relatively small fraction of fine char carbon that is not converted in the second-stage partial oxidizer exits the second-stage via stream 240 along with the syngas. These factors lead to minimal-to-no char carbon accumulation in the second-stage partial oxidizer 200 and the char carbon concentration in the bed can be less than approximately 0.2 wt %. At this low char carbon concentration in the second-stage fluidized bed, the probability is very low for hot char carbon particles to collide and form a larger particle and ultimately lead to a clinker.

Further, all the relatively large inert particles in the range of approximately 10-500 microns in the second-stage fluidized bed are nearly at the same bulk temperature. As these inert particles are present in far excess compared to fine char carbon (less than approximately 0.2 wt %) and tar, they will rapidly quench the high surface temperature of the fine char carbon as it is partially oxidized. Hence, the partial oxidizer second-stage fluidized bed can have minimal-to-no hot spots and can be operated at much higher temperatures than gasifier 100 without the risk of forming clinkers or agglomerates.

The inventory of inert particles in the second-stage fluidized bed is maintained with the second-stage cyclone 250 to collect entrained particles in the syngas stream 230 that exits the second-stage fluidized bed partial oxidizer. The collected bed particles can be recycled back through collected bed particles stream 260 to the second-stage fluidized bed. Excess bed inventory can be withdrawn through stream 220 for disposal after cooling and depressurization. The syngas stream 240 exiting the second-stage cyclone 250 contains mostly fine ash and any unreacted fine char carbon dust. The hot syngas stream 240 which can be up to approximately 1400° C. then enters the syngas cooler 300.

Syngas cooler 300 can comprise a multistage internally circulating fluidized bed (ICFB) cooler to gasify high ash, high ash fusion temperature bituminous coal. Multistage ICFB coolers are disclosed in U.S. Patent Publication No. 2004-0100902, incorporated herein by reference. The ICFB cooler 300 cools the syngas to a preferable temperature in the range of approximately 300° C. to approximately 500° C. to generate steam and to superheat steam while cooling the syngas. In the ICFB cooler, the syngas can be cooled using an inert circulating media 310 to transfer heat from the syngas to heat transfer surfaces 320 preferably without the heat transfer surfaces directly contacting the syngas. As a result, the ICFB syngas cooler is much more effective than conventional coolers in overcoming fouling, corrosion, erosion and maintainability issues.

The third cyclone 350 downstream of the syngas cooler is effective in collecting unreacted char carbon as it operates at lower temperature and higher loads due to fine ash particles that pass through the ICFB syngas cooler. The cyclone's char carbon collection efficiency can be increased by maintaining a mass ratio of inert particles to unreacted char carbon of at least 10 in the syngas stream 330 at the inlet of the cyclone. The desired loading at the inlet of the cyclone can be achieved by appropriately selecting the size distribution of the inert media in the ICFB cooler and adjusting the cooler gas superficial velocity. A part of the collected char carbon along with fine inert materials can be added as stream 380 to the bottom of the second-stage partial oxidizer 200 as necessary to further convert char carbon and increase overall carbon conversion. Also, the cold cyclone's high collection efficiency reduces the loading to dust filtration unit 400 and fine ash handling system 500 downstream.

The dust filtration unit 400 can comprise a barrier filter to remove at least a portion of the remaining fine particles. The fine dust can be filtered with, for example, ceramic or sintered metal candle filters that can sustain the process temperature. Candle filters can reduce the approximately 4,000 to approximately 20,000 parts per million by weight (ppmw) dust concentration at the inlet of unit 400 to approximately 0.1 ppmw to approximately 1 ppmw at the exit of the unit, producing the nearly dust-free syngas 450 for downstream end-use. The fine particles can be collected in fines receiver vessel 500 and disposed through stream 550 after further cooling and depressurization using, for example, a Continuous Fine Ash Depressurization (CFAD) system 510 disclosed in U.S. Pat. No. 8,066,789, which is hereby incorporated by reference. Fines from the third cyclone 350 can also be cooled and depressurized through another CFAD system 510 to produce stream 370 which can be disposed through stream 550.

Figure 3:
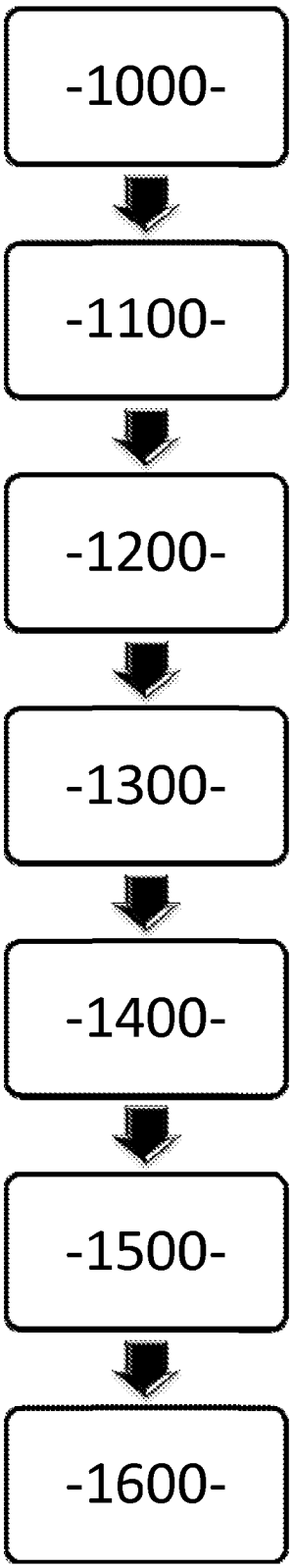
FIG. 3 is schematic view of a process for high ash, high ash fusion temperature bituminous coals according to a preferred embodiment of the present invention.

As shown in FIG. 3, a preferred method of gasifying high ash, high ash fusion temperature bituminous coal to achieve above 90% carbon conversion, comprises gasifying 1000 a combination of a bituminous coal stream, a gasifier oxidant stream, and steam, to produce a syngas stream, the syngas stream containing at least one unwanted species, for example, char carbon and/or tar. A further step comprises partially oxidizing 1100 the syngas stream from step 1000 and converting at least a portion of the unwanted species into a syngas stream. Partially oxidizing 1100 comprises combining the syngas stream from step 1000 with a partial oxidizer oxidant and steam streams, and a collected bed particles stream from an unwanted species removal step 1200.

The unwanted species removal step 1200 comprises receiving the syngas stream from step 1100, and removing at least a portion of the unwanted species along with elutriated inert bed material from the syngas stream, which unwanted species can comprise char carbon and tar, among other species.

Syngas stream exiting step 1200 contains mostly fine ash and any unreacted fine char carbon dust. The relatively hot syngas stream then enters a syngas cooler step 1300 to cool the syngas from the steps 1100/1200. The syngas cooler step 1300 cools the syngas stream.

The cooler syngas stream enters a third cyclone for further removal (step 1400) of fine ash and unreacted fine char from the syngas stream. The efficiency of the third cyclone is much higher compared to the second cyclone as it operates at much lower temperatures. A portion of collected fines is step 1400 is recycled back for further partial oxidation in step 1100. The syngas stream exiting a third cyclone can enter a filtration step 1500. Preferably, filtration step 1500 can reduce the dust concentration to produce a nearly dust-free syngas stream.

The step of disposing fines 1600 can be implemented after further cooling and depressurization using, for example, a CFAD system.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A gasification system for high ash, high ash fusion temperature bituminous coal comprising:

a gasifier combining a bituminous coal stream and a gasifier oxidant stream to produce a gasifier syngas stream containing an unwanted species at a first concentration, wherein the gasifier operates within an operating gasifier temperature range, an operating gasifier gas superficial velocity range, and an operating gasifier pressure range at an exit of the gasifier;

a partial oxidizer that combines the gasifier syngas stream and a partial oxidizer oxidant stream to produce a partial oxidizer syngas stream containing the unwanted species at a second concentration being lower than the first concentration, wherein the partial oxidizer operates within an operating partial oxidizer temperature range, an operating partial oxidizer gas superficial velocity range, and an operating partial oxidizer pressure range at an exit of the partial oxidizer;

an unwanted species removal system that removes at least a portion of an unwanted species from the partial oxidizer syngas stream;

a syngas cooler to cool the partial oxidizer syngas stream; and a filtration system through which the cooled partial oxidizer syngas stream passes; and wherein a removal system-to-partial oxidizer return feed to return at least a portion of an unwanted species via an unwanted species stream from the removal system to the partial oxidizer, wherein the partial oxidizer combines steam and the unwanted species stream with the gasifier syngas stream and a partial oxidizer oxidant stream to produce the partial oxidizer syngas stream.

2. The gasification system of claim 1 further comprising a removal system-to-partial oxidizer return feed to return at least a portion of an unwanted species via an unwanted species stream from the removal system to the partial oxidizer, wherein the partial oxidizer combines steam and the unwanted species stream with the gasifier syngas stream and a partial oxidizer oxidant stream to produce the partial oxidizer syngas stream.

3. The gasification system of claim 1, wherein the system achieves over approximately 98% carbon conversion into syngas gasifying bituminous coals with ash content above approximately 15 wt % and the ash having initial deformation temperatures above approximately 1500° C.

4. The gasification system of claim 1, wherein the gasifier is a circulating fluidized bed transport gasifier, and wherein the partial oxidizer is a fluidized bed partial oxidizer.

5. The gasification system of claim 1, wherein steam is combined with the bituminous coal stream and a gasifier oxidant stream to produce the gasifier syngas stream.

6. The gasification system of claim 1, wherein the operating gasifier temperature range is approximately 900° C. to approximately 1100° C., the operating gasifier gas superficial velocity range is approximately 12 ft/s to approximately 50 ft/s, and the operating gasifier pressure range at an exit of the gasifier is approximately 30 psia to approximately 1000 psia.

7. The gasification system of claim 1, wherein the operating partial oxidizer temperature range is approximately 1100° C. to approximately 1400° C., the operating partial oxidizer gas superficial velocity range is approximately 3 ft/s to approximately 6 ft/s, and the operating partial oxidizer pressure range at an exit of the partial oxidizer is approximately 5 psia to approximately 35 psia lower than the gasifier pressure range at the exit of the gasifier.

8. The gasification system of claim 3, wherein the operating gasifier temperature range is at least 350° C. below the ash initial deformation temperature.

9. The gasification system of claim 1, the unwanted species comprising char carbon.

10. The gasification system of claim 1, the unwanted species comprising tar.

11. The gasification system of claim 1, the unwanted species comprising ash fines.

12. The gasification system of claim 1, wherein the system achieves over approximately 90% carbon conversion into syngas gasifying bituminous coals with ash content above approximately 15 wt %.

13. The gasification system of claim 1, wherein the gasifier is configured as a circulating fluidized bed transport gasifier with bituminous coal particles of an average size in the range of approximately 150 to approximately 300 microns fed tangentially into a dense bed and in an oxygen rich lower region of the gasifier.

14. The gasification system of claim 1, wherein the gasifier is configured as a circulating fluidized bed transport gasifier comprising an oxygen rich lower region and a loop seal including a riser;

wherein bituminous coal is fed into a dense bed and in the oxygen rich lower region of the gasifier; and wherein caking bituminous coals are fed into the riser of the loop seal of the circulating fluidized bed transport gasifier with solid circulation rates at least 100 times the bituminous coal feed rate to limit agglomerate formation.

15. The gasification system of claim 1, wherein the unwanted species removal system comprises a cyclone downstream from the syngas cooler to separate unwanted species from the partial oxidizer syngas stream;

wherein the unwanted species comprises fine char carbon and ash; and wherein the cyclone operates in the range of approximately 300° C. to approximately 500° C. and separates fine char carbon and ash from the partial oxidizer syngas stream from the syngas cooler to reduce loading to the downstream filtration system.

16. The gasification system of claim 15, wherein the syngas cooler comprises an internally circulating fluidized bed cooler using an inert circulating media to transfer heat from the partial oxidizer syngas stream to heat transfer surfaces without the heat transfer surfaces directly contacting the partial oxidizer syngas stream.

17. The gasification system of claim 16 further comprising a removal system-to-partial oxidizer return feed to return at least a portion of unwanted species via an unwanted species stream from the cyclone to the partial oxidizer, wherein the partial oxidizer combines steam and the unwanted species stream with the gasifier syngas stream and a partial oxidizer oxidant stream to produce the partial oxidizer syngas stream.

18. The gasification system of claim 16 further comprising a removal system-to-partial oxidizer return feed to return at least a portion of unwanted species via an unwanted species stream from the cyclone to the partial oxidizer, wherein the amount of unwanted species recycled to the partial oxidizer achieves a desired carbon conversion percentage.

19. The gasification system of claim 17, wherein unwanted species is filtered in the filtration system to produce a clean syngas stream for further downstream processing.

20. The gasification system of claim 19, wherein unwanted species is depressurized from the cyclone and filtration system for storage and disposal.

* * * * *